US005165320A

United States Patent [19]

Ravn

[11] Patent Number: 5,165,320

[45] Date of Patent: Nov. 24, 1992

[54] FLUID-CONTROLLED SERVO-ARRANGEMENT

[75] Inventor: Kjeld Ravn, Sydals, Denmark

[73] Assignee: Danfoss A/S, Nordborg, Denmark

[21] Appl. No.: 789,799

[22] Filed: Nov. 12, 1991

Related U.S. Application Data

[63] Continuation of Ser. No. 464,962, Jan. 16, 1990, abandoned.

[30] Foreign Application Priority Data

Jan. 19, 1989 [DE] Fed. Rep. of Germany ..... 3901475

[51] Int. Cl.[5] ..... F15B 13/04

[52] U.S. Cl. ..... 91/31; 91/51; 91/444; 91/454; 91/459

[58] Field of Search ..... 91/31, 47, 51, 52, 275, 91/361, 444, 446, 441, 454, 459

[56] References Cited

U.S. PATENT DOCUMENTS

| | | | |
|---|---|---|---|
| 3,045,650 | 7/1962 | Ambrosini | 91/51 |
| 3,430,540 | 3/1969 | Linz | 91/454 |
| 3,763,744 | 10/1973 | Fournell et al. | 91/32 |
| 4,066,103 | 1/1978 | Tondrup | 91/52 |
| 4,106,390 | 8/1978 | Kodairo et al. | 91/361 |
| 4,211,256 | 7/1980 | Sturtz | 91/52 |
| 4,416,187 | 11/1983 | Mystrom | 91/361 |
| 4,773,300 | 9/1988 | Klatt et al. | 91/454 |
| 4,870,892 | 10/1989 | Thomsen et al. | 91/454 |

FOREIGN PATENT DOCUMENTS

| | | | |
|---|---|---|---|
| 2011713 | 9/1971 | Fed. Rep. of Germany | 91/361 |
| 59005 | 5/1981 | Japan | 91/441 |
| 124807 | 7/1983 | Japan | 91/454 |

*Primary Examiner*—Thomas E. Denion
*Assistant Examiner*—F. Daniel Lopez
*Attorney, Agent, or Firm*—Wayne B. Easton

[57] ABSTRACT

Disclosed is an arrangement that includes a piston cylinder unit having pressure chamber in which fluid acts in opposition to a spring piston combination, a pressure generator and a fluid conduit extending between a tank and the tank. A first and a second valve are connected in series between the pressure generator and tank with the pressure chamber being in fluid communication with the connection between the valves. In known arrangements of the above type there is dead play wherein not every control signal corresponds to a defined position of the piston in the cylinder. However as disclosed herein the setting accuracy is improved by a throttle in parallel with valve that is fluidly connected between the pressure chamber and the piston cylinder unit. Also third and fourth valves may be connected in series between the pressure generator and tank and have a fluid connection between the third and fourth valves to the unit pressure chamber that is opposite the first chamber to provide a bridging circuit.

8 Claims, 3 Drawing Sheets

FLUID-CONTROLLED SERVO-ARRANGEMENT

This application is a continuation application of Ser. No. 07/464,962, filed Jan. 16, 1990 (now abandoned).

The invention relates to a fluid-controlled servo-arrangement comprising a piston-cylinder unit having at least one pressure chamber influenced by the fluid, pressure generating means for the fluid, a fluid tank and a conduit between the pressure generating means and the tank containing in series a first valve on the pressure side and a second valve on the tank side, the pressure chamber being connected to a conduit section between the two valves.

In a known arrangement of this kind (U.S. Pat. No. 4,416,187 which corresponds to DE-OS 31 04 704), a piston connected to a slide is subjected to pressure on two sides. Depending on the pressure difference, the piston is intended to assume a predetermined position. This position is derived from a measurement converter and compared with a desired value in a comparator. Departures are fed back into the system, i.e. when there are departures in the position from the desired value, the pressure on one side of the piston or the other is increased to reduce the difference between the desired and existing values to zero. The pressure change is brought about in that magnetic valves are operated by pulse chains having a particular scanning ratio, i.e. the ratio between the length of the pulse and the length of the period. The principle of this operation is known from "Control Engineering", May 1965, pages 65 to 70. However, the comparator generates an output signal only upon a predetermined minimum difference between the desired and existing values, the output signal being adapted to change the pressures at both sides of the piston (see for example DE-OS 37 20 347). This minimum difference, also termed dead play, is necessary to avoid oscillation of the system.

By reason of this dead play, however, a kind of hysteresis exists on regulating the postion of the slide. In the case of small regulating departures, this hysteresis makes it possible for each control signal to correspond to two slide positions depending on the direction from which ths slide was last moved. This prevents a specific relationship between the slide position and the control signal. Conversely, the slide can stay in its assumed position even when the control signal is supposed to move the slide through a certain distance which is less than the dead play. Finally, the slide can wander about its desired position within the dead play without any regulation taking place.

It is the problem of the present invention to provide a fluid-controlled servo-arrangement in which there is a clear relationship between the control signal and the slide position. This problem is solved in a fluid-controlled servo-arrangement of the aforementioned kind in that a throttle is provided in parallel to the first valve.

If, by controlling the valves, the piston has been displaced to a particular position and the valves are closed, a pressure is applied by the pressure generating means by way of the throttle and by means of this pressure the piston is displaced against the force of the spring until the difference between the desired and existing values is large enough for the regulation to take place again. Thus, even with the valves closed, due to the provision of the throttle, fluid under pressure from the pressure generator is applied to the piston to act to move the piston against the action of the spring. This regulation will, for example, open or close the second valve on the tank side, possibly by pulse control, until the desired position of the piston pushed back by the force of the spring has been achieved again. In a stable condition, a pressure is then obtained between the valves again for holding the piston and thus the slide in the desired position, mainly at the lower edge of the dead play range, without permitting the piston to move within a distance of dead play.

In a servo arrangement in which the piston-cylinder unit has two cylinders and two springs acting on opposite sides of the piston, wherein two conduits are provided between the pressure generating means and the tank and wherein the piston-cylinder unit is arranged as a bridge between the two conduit sections between the first and second valves, a throttle is preferably provided in parallel with the first valve in each of the two conduits. Thus, the piston-cylinder unit forms a diagonal in a rectangle wherein the two first valves are disposed in the sides above the diagonal and the two second valves are disposed in the sides below the diagonal.

In such a bridge arrangement, the slide is actively influenced by the control in both directions of movement. By providing two throttles, the advantageous effects are obtained for both directions of movement. When the valves are closed, the piston is moved by the force of the two springs out of the position set by the control towards the neutral position where the two spring forces balance each other out because the pressure in the pressure chambers is set by way of the two throttles to the same supply pressure. If, during this movement, the dead play range is exceeded, i.e. a departure occurs between the desired and existing value, regulation takes place and returns the piston to the desired position. In this way, the piston will always be on the neutral position side of the dead play range, whereby a clear relationship is achieved between the control signal and the slide position.

The arrangement of the two throttles parallel to the respective first valves has the advantage that a fine correction can be achieved by a control, e.g. pulse control of each second valve on the tank side.

Advantageously, the second valve on the tank side responds more rapidly than the first valve on the pressure side.

In a preferred embodiment, the first valve is in the form of a check valve opening towards the pressure chamber and a second throttle is disposed in series with the parallel circuit of the throttle and first valve. Check valves are simply constructed valves which can be economically made. In this arrangement, control takes place by way of the second valve, fluid only being replenished by way of the first valve. The second throttle determines the speed with which the piston can move when the check valve opens and the first throttle is practically short circuited or bridged. By reason of the fact that, when the check valve is closed, two throttles are disposed in series, the first throttle can be chosen somewhat larger than when there is a single throttle. This very considerably reduces the sensitivity of the throttle to dirt particles.

In another preferred embodiment of the same kind, the first throttle is arranged parallel to the series circuit of first valve and second throttle. The maximum speed of the piston is thereby determined by the shunt connection of first throttle and second throttle.

Advantageously, a check valve opening towards the pressure chamber is provided parallel to the second valve. This permits fluid to be sucked back from the tank if, by reason of external influences, the piston of the piston-cylinder unit is to move rapidly in a predetermined direction without sufficient fluid being able to flow from the pressure generating means for example on account of the second throttle.

In a particularly preferred embodiment, the second valve is in the form of a magnetic valve which is open when de-energised. In the case of small regulating departures, one can thus ensure that the control is carried out with very narrow pulses, i.e. the scanning behaviour is very small. Magnetic valves which are open when de-energised can very rapidly be brought back to the closed condition after a short limited opening movement. This is assisted by the fact that the remanent magnetization decays to only a small extend on account of the reduced air gap, so that the re-establishment of the magnetic field is initiated from a more favourable starting point and therefore takes place very rapidly. These valves have the additional advantage that, in the case of power failure or some other fault of an appropriate kind, they permit a neutral position of the piston in the control. To ensure as rapid a return of the piston as possible, these valves preferably have an adequate stroke for the return flow of the fluid from one pressure chamber to the tank. The other pressure chamber can then be replenished by way of the check valve bridging the other magnetic valve.

It is also of advantage for the first valve to be in the form of a magnetic valve which is closed when de-energised. It is only in the case of larger regulating departures that the scanning ratio becomes sufficiently large to cause the first valve on the pressure side, which is generally slower, to respond, i.e. to open. By reason of the fact that the first valve is closed when de-energised, one also ensures that little fluid is consumed in the de-energised condition because only little fluid passes through the throttle.

Preferably, the first throttle is formed as a leakage point in the valve seat or in the closure member. This achieves a very compact construction. No separate conduits are necessary to lead the fluid to the throttle parallel to the valve. When opening the valve, the throttle is automatically cleaned.

Examples of the invention will now be described with reference to the drawing, wherein.

Figure 1:
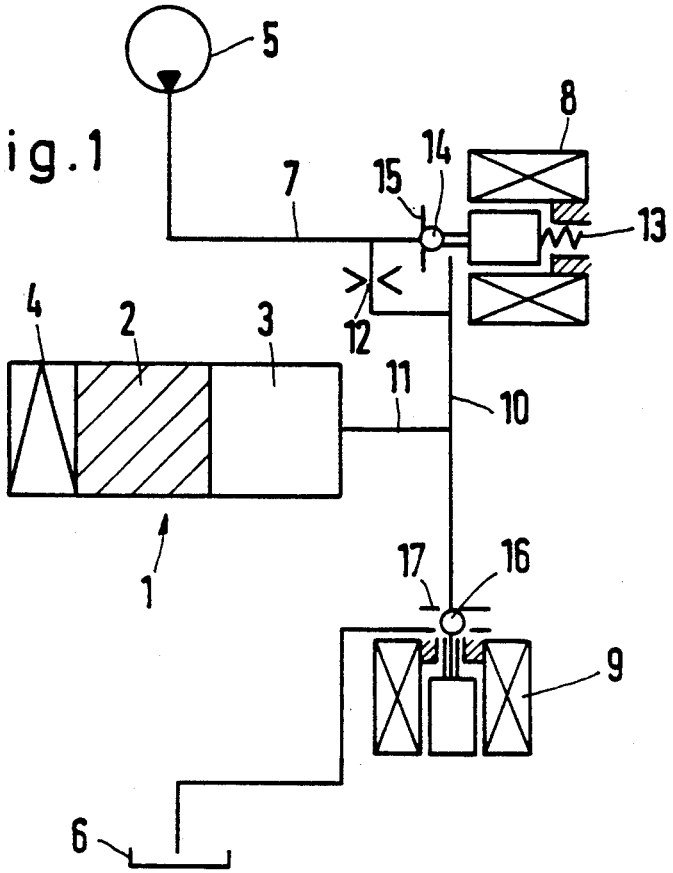
FIG. 1 illustrates one embodiment of the fluid-controlled servo-arrangement.

FIG. 1 illustrates a servo-arrangement comprising a piston-cylinder unit 1, in which a piston 2 is moved against the force of a spring 4 by a fluid which builds up a pressure in a pressure chamber 3. The fluid pressure is produced by pressure generating means 5, for example a pump 5, and conveyed through a conduit 7 into a tank or vessel 6. The conduit 7 contains in series two valves 8, 9, the first valve 8 being disposed on the pressures side, i.e. in the conduit 7 following the pressure generating means 5, and the second valve 9 being disposed on the tank side, i.e. in the conduit 7 in front of the tank 6. Between the two valves 8 and 9, the conduit 7 has a conduit section 10 from which a branch conduit 11 leads to the pressure chamber 3.

The first valve 8 is in the form of magnetic valve which is closed when de-energised, i.e. a valve element 14 is pressed by the force of a spring 13 against a valve seat 15. If the magnetic valve 8 is supplied with current, for example even with pulses, an armature pulls the closure member 14 downwardly from the valve seat 15 and fluid can flow through the conduit 7 into the conduit section 10.

The second valve 9 is likewise in the form of a magnetic valve but this is open in the de-energised condition. Only when a current is applied to the magnetic valve, a closure member 16 will be pressed against a valve seat 17.

Parallel to the first valve 8 there is a throttle 12. Independently of the position of the first valve 8, pressure can reach the piston-cylinder unit 1 from the pressure generating means 5 and displace the piston 2 against the force of the spring 4.

To move the piston 2 to the left during operation, the first valve 8 is opened. Pressure from the pressure generating unit 5 thereby reaches the pressure chamber 3 and displaces the piston 2 to the left against the force of the spring 4. When the desired position has been reached, the first valve 8 closes. Nevertheless, pressure reaches the pressure chamber 3 by way of throttle 12 and displaces the piston 2 further to the left until the difference between the desired and existing values is sufficiently large to allow regulation to take place. The regulation thereupon opens the second valve 9, whereupon a pressure reduction takes place in the pressure chamber 3. If the piston moves too far to the right, the valve 9 closes again. After a short time, a stable condition has been reached insofar that, controlled by the second valve, precisely so much fluid flows through the throttle 12 that a pressure is maintained in the pressure chamber 3 that is exactly the same size as the counter pressure of the spring in the desired position.

If the piston 2 is to be displaced to the right, the second valve 9 opens. When the desired position has been reached, the valve closes and the regulation holds the piston in the desired position in the manner described above.

Figure 2:
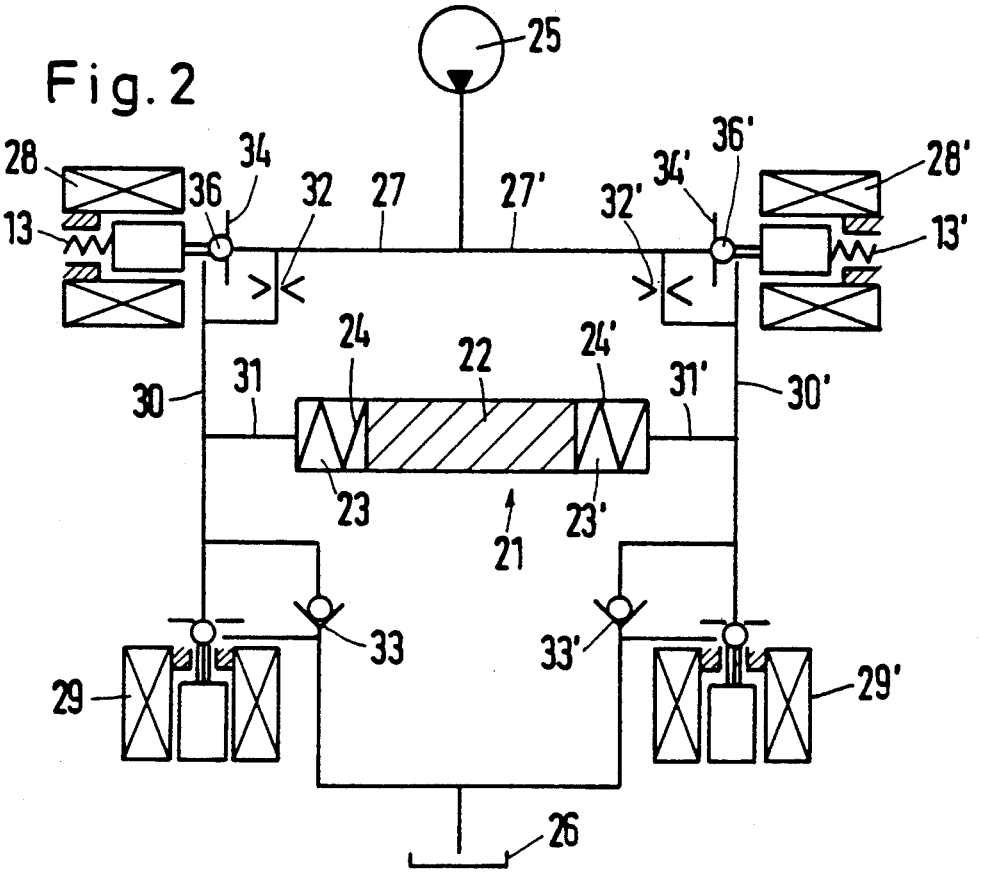
FIG. 2 shows another embodiment of the servo-arrangement.

FIG. 2 illustrates a further embodiment in which a piston- cylinder unit 21 comprises two pressure chambers 23, 23' each containing a spring 24, 24'. The springs 24, 24' displace the piston 22 to a neutral position. The piston 22 can be moved out of this neutral position only by pressure that is build up in the pressure chambers 23, 23'. The springs 24, 24' may be compressed, but they can only expand up to the neutral position. This ensures that the pressure in the pressure chambers 23, 23' only acts against the force of the opposite spring 24, 24' and is not supported by the spring in the same pressure chamber 23, 23'.

Pressure generating means 25, for example a pump or an accumulator, convey a fluid, for example a hydraulic fluid or a gas, through two parallel conduits 27, 27' to the tank 26. Each conduit contains a first valve 28 on the pressure side and a second valve 29 on the tank side. Between the first and second valves, each conduit 27, 27' has a conduit section 30, 30' from which a respective branch conduit 31, 31' brings about the connection to the pressure chamber 23, 23' of the piston-cylinder unit 21.

As in FIG. 1, each first valve 28, 28' is a magnetic valve which is closed when de-energized, whereas the second valve 29, 29' is a magnetic valve which is open in the de-energised condition.

The first valve is bridged by a respective throttle 32, 32', i.e. each throttle 32, 32' is in parallel with the associated first valve 28, 28'.

The second valve is bridged by a check valve 33, 33' opening towards the pressure chamber 23, 23', i.e. this check valve 33, 33' is in parallel with the second valve 29, 29'. The check valve 33, 33' has the task of permitting fluid to be sucked back into the pressure chambers 23, 23' from the tank 26 when the piston 22 is moved through an external cause. If, for example, the piston 22 is moved to the right by an external force, a vacuum is created in the chamber 23 which can possibly not be sufficiently rapidly replenished by way of the throttle 32. In this case, the check valve 33 opens. In the reverse case, the check valve 33' opens when the piston is moved very quickly to the left. The arrangement functions much the same as that of FIG. 1. Out of the neutral position determined by the springs 24, 24' the piston 22 can, for example, be displaced to the left when the first valve 28' on the right hand side opens. The counterpressure is thereby produced by the spring 24 on the left hand side of the piston 22. When the piston 22 has reached the desired position, the first valve 28' closes again, i.e. a closure element 36' is pressed by the force of a spring against a valve seat 34'. Pressure from the pressure generating means reaches both pressure chambers 23, 23' through the throttles 32, 32'. Since the force of the spring 24 acts on the left hand side of the piston 22, the spring 24 being more compressed than the spring 24' on the right hand side and therefore exerting a stronger force on the piston than does the spring 24', the piston will be displaced to the right again until the regulation takes place again. This regulation opens the second valve 29 on the left hand side and allows the pressure to escape from the pressure chamber 23. In a stable condition, which is effected by the regulation, exactly as much fluid will flow through the throttle 32 as is necessary to ensure that the pressure difference between the pressure chambers 23, 23' is exactly the same as the pressure difference between the springs 24, 24' in the set position.

Figure 3:
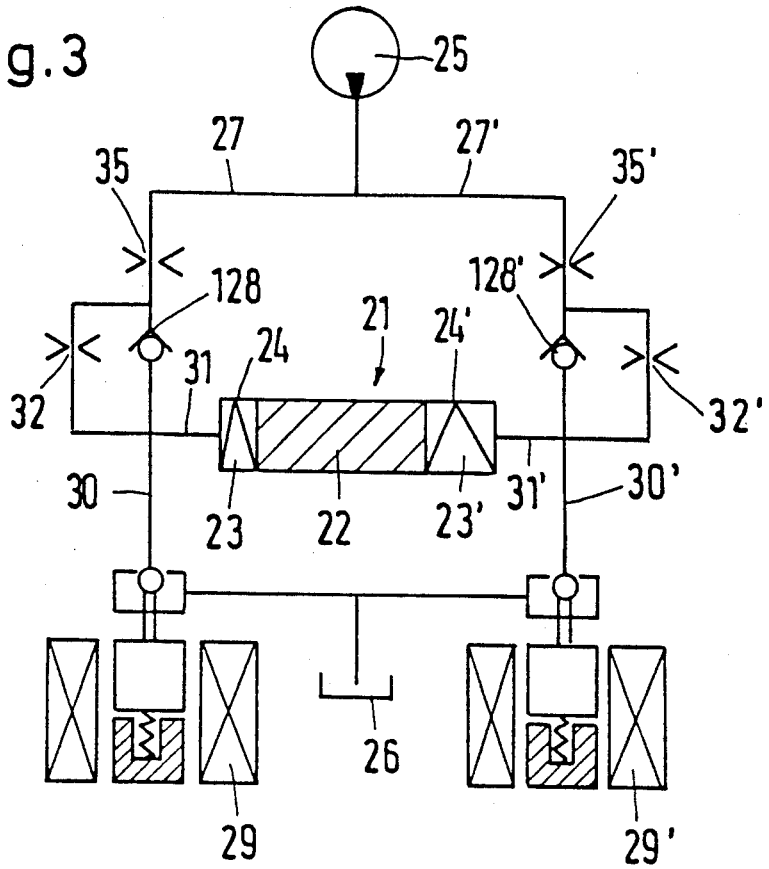
FIG. 3 shows a third embodiment of the servo-arrangement with check valves as the first valves.

FIG. 3 illustrates a further embodiment which differs from that of FIG. 2 in that the two first valves are not in the form of magnetic valves as in FIG. 2 but check valves 128, 128' which open towards the pressure chambers 23, 23' of the piston-cylinder unit 21. The regulation takes place exclusively through the second valves 29, 29'. For example, in order to displace the piston 22 to the left, the second valve 29 opens on the left hand side whereby the pressure in the pressure chamber 23 drops. In the right hand pressure chamber 23', the pressure of the pressure generating means 25 continues to obtain by way of the throttle 32' and this pressure displaces the piston 22 to the left. Since the pressure chamber 23' on the right hand side of the piston 22 now increases, fluid is replenished through the right hand check valve 128' from the pressure generating means 25 through the conduit 27'. When the piston 22 has reached its desired position, the magnetic valve 29 on the left hand side is closed. The pressure from the pressure generating means 25 now acts on both sides of the piston-cylinder unit 21 through the throttles 32, 32'. However, since the piston 22 is additionally biased on the left hand side by the more strongly compressed spring 24, the pressure on the left hand side is larger. The piston 22 therefore wanders to the right again until the regulation comes into effect and the second valve 29 on the left hand side opens. Fluid from the pressure generating means 25 thereupon flows through the conduit 27 and the throttle 32 on the left hand side into the conduit section 30. The pressure drop at the throttle 32 reduces the pressure in the left hand pressure chamber 23. The second valve 29 on the left hand side now has its opening width regulated so that the pressure in the pressure chamber 23 reduced by the throttle 32 together with the pressure of the spring 24 is exactly equal to the unreduced pressure of the pressure generating means 25 through the throttle 32' on the right hand side. The opening width can be determined by a scanning ratio.

A second throttle 35, 35' is provided in series with and downstream of the parallel circuit consisting of the throttle 32, 32' and check valve 128, 128'. This throttle limits the speed with which the piston can move. If, for example, the check valve 128 on the left hand side is fully open, the fluid flow is limited exclusively by the second throttle 35. In a case where the first valve 128, 128' is closed, the two throttles 32, 35 or 32', 35' lie in series. The pressure drop produced at each throttle is therefore summated. For this reason, the first throttle 32, 32' can have a larger bore or a larger opening cross-section, which considerably reduces the danger of soiling.

Figure 4:
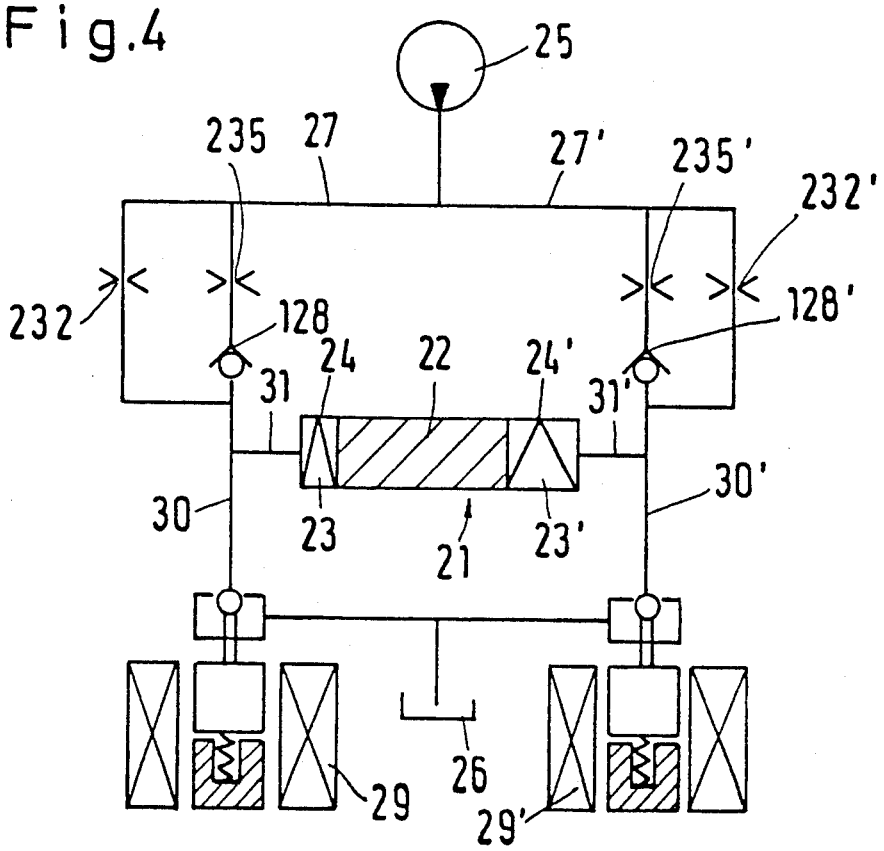
FIG. 4 shows a further embodiment of the servo-arrangement with check valves as the first valves.

FIG. 4 illustrates a further embodiment which differs from that of FIG. 3 in that the first throttle 232, 232' is no longer only parallel to the first valve 128, 128' but parallel to the series circuit consisting of the first valve 128, 128' and the second throttle 235, 235'. When the first valve 128, 128' is closed, the pressure drop in the conduit 27, 27' is caused exclusively by the first throttle 232, 232'. On the other hand, the maximum fluid that can be brought into the pressure chamber 23, 23' by the pressure generating means 25 is governed by the parallel circuit of the first and second throttle 232, 235 or 232', 235'. Without changing the structural size of the throttle, this permits a considerably higher speed of movement of the cylinder 22.

Figure 5:
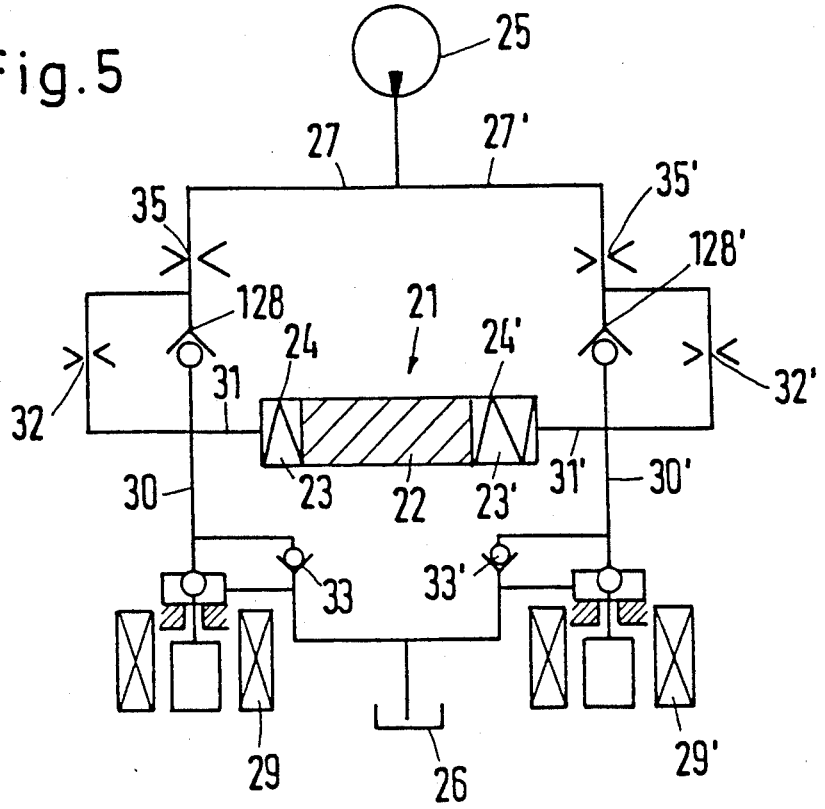
FIG. 5 shows another embodiment of the servo-arrangement with a parallel connection of a check valve and the second valve.

FIG. 5 illustrates a further embodiment corresponding substantially to that of FIG. 3. In addition, however, a check valve 33, 33' opening towards the pressure chamber 23, 23' is provided in parallel with the second valve 29, 29'. This check valve serves to avoid cavitation in the pressure chambers 23, 23' when the cylinder 22 is forced to move. If, for example, the cylinder 22 is moved to the right through external influences, the first valve 128 on the left hand side will open. However, since the fluid flow through the second throttle 35 is limited, it is possible that not enough liquid will be replenished from the pressure generating means 25. In this case, the check valve 33 will open and fluid can be sucked from the tank 26.

Figure 6:
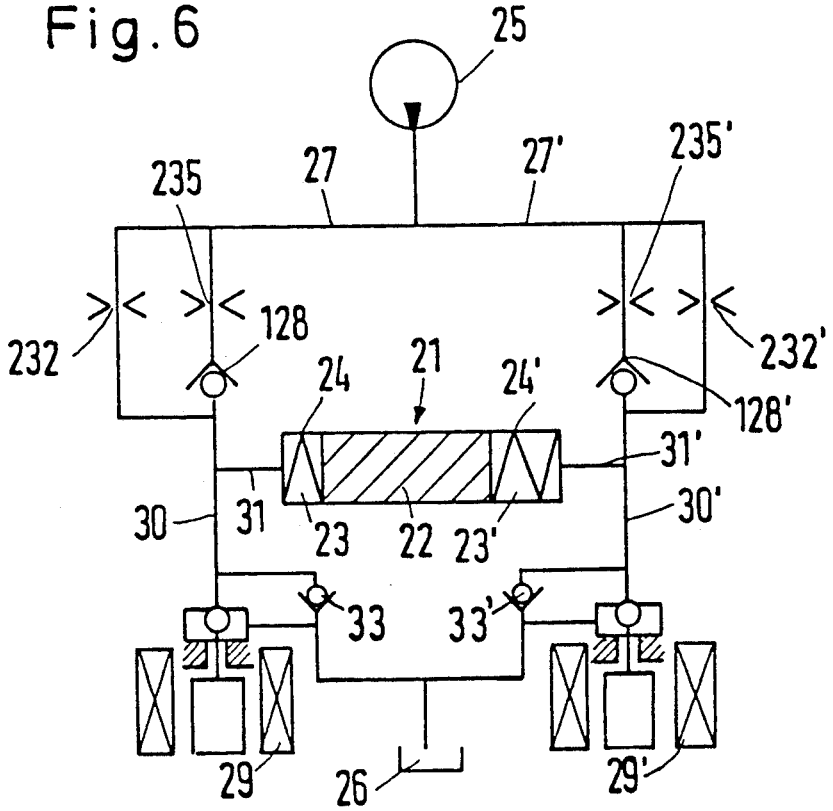
FIG. 6 shows an embodiment of the servo-arrangement similar to FIG. 5.

Similarly, the FIG. 6 embodiment substantially corresponds to that of FIG. 4, a check valve 33, 33' being provided in parallel with the second valve 29, 29' so that fluid can be sucked by it out of the tank 26 into the pressure chamber 23, 23'.

The first throttle 32, 32' can in a simple manner be formed by a leakage point between the closure element 14, 36, 36' and the valve seat 15, 34, 34'. For this purpose, a recess is provided in the valve seat 15, 34, 34' or the closure member 14, 36, 36' is machined so that at a particular position it no longer sealingly abuts the valve 25, 34, 34'. This arrangement has the advantage that, during opening of the first valve, the first throttle 12, 32, 32' is cleaned. If dirt particles have accumulated there they are pulled away by the passing fluid. Naturally, other throttles are conceivable in the housing of the first valve 8, 28, 28', 128, 128', for example a throttle which is guided by the closure member.

I claim:

1. A fluid pressure controlled servo arrangement, comprising, a housing forming a space defining a cylinder section, a piston slidably mounted in said cylinder section and forming left and right fluid pressure chamber means at the left and right ends of said cylinder section, fluid pressure generating means for supplying pressurized fluid to both of said chamber means and tank means for receiving fluid drained from both of said chamber means, left and right supply conduit means respectively between said fluid pressure generating means and said left and right chamber means, left and right drain conduit means respectively between said left and right chamber means and said tank means, selectively and individually operable left and right setting valve means respectively in said left and right supply conduit means to effect moving said piston in an opposite direction from a neutral position to a desired respective right or left position, biasing means in each of said chambers for biasing said pistion oppositely relative to said direction, selectively and indidually operable left and right drain valve means respectively in said drain conduit means, left and right throttle valve means respectively in said left and right supply conduit means respectively bypassing said left and right setting valve means, said left and right throttle valve means having fixed openings providing continuous fluid communication between said fluid pressure generating means and said left and right fluid pressure chamber means.

and one of said left and right drain valve means being selectively operable in cooperation with said throttle valve means and said biasing means to regulate the position of said piston relative respectively to said right or left desired position when both said setting valve means and the opposite one of said drain valve means are closed.

2. A fluid pressure controlled servo arrangement according to claim 1 wherein said setting and drain valve means are electro-magnetic valves.

3. A fluid pressure controlled servo arrangement according to claim 2 wherein said setting valve means are of the normally closed type and said drain valve means are of the normally open type.

4. A fluid pressure controlled servo arrangement according to claim 1 wherein said biasing means include left and right spring means respectively in said chambers for biasing said piston in opposite directions.

5. A fluid pressure controlled servo arrangement according to claim 4 wherein each of said spring means taken seperately is only effective to move said piston to a centered position but not further than said centered position.

6. A fluid pressure controlled servo arrangement according to claim 1 wherein said setting valve means are check valves which open in the direction of said fluid pressure chamber means and are controlled respectively by the operation of said drain valve means.

7. A fluid pressure controlled servo arrangement, comprising, a housing forming a space defining a cylinder section, a piston slidably mounted in said cylinder section and forming fluid pressure chamber means at least at one end of said cylinder section, fluid pressure generating means for supplying pressurized fluid to said chamber means and tank means for receiving fluid drained from said chamber means, supply conduit means between said fluid pressure generating means and said chamber means, drain conduit means between said chamber means and said tank means, selectively operable position setting valve means in said supply conduit means for moving said piston in a direction from a rest position to a desired position, biasing means for biasing said piston oppositely relative to said direction, drain valve means in said drain conduit means, throttle valve means in said supply conduit means bypassing said position setting valve means, said drain valve means being operable in cooperation with said throttle valve means and said biasing means to regulate the position of said piston relative to said desired position when said position setting valve is closed.

8. A fluid pressure controlled servo arrangement according to claim 7 wherein said biasing means is a spring.

* * * * *